US005482189A

United States Patent [19]

Dentler et al.

[11] Patent Number: 5,482,189

[45] Date of Patent: Jan. 9, 1996

[54] CAULK GUN

[75] Inventors: Christopher G. Dentler, Portland, Oreg.; William Zagone, Ridgefield, Wash.

[73] Assignee: Z-Pro International, Inc., Portland, Oreg.

[21] Appl. No.: 320,607

[22] Filed: Oct. 11, 1994

Related U.S. Application Data

[62] Division of Ser. No. 269,063, Jun. 30, 1994.

[51] Int. Cl.[6] ..... B67D 5/42

[52] U.S. Cl. ..... 222/391; 222/327

[58] Field of Search ..... 222/327, 334, 222/326, 386, 386.5, 389, 390, 391

[56] References Cited

U.S. PATENT DOCUMENTS 2,786,604 3/1957 Collins ..... 222/327 X 5,341,964 8/1994 Medved ..... 222/327

*Primary Examiner*—Gregory L. Huson

*Attorney, Agent, or Firm*—Klarquist Sparkman Campbell Leigh & Whinston

[57] ABSTRACT

A dripless caulk gun is disclosed having a biased-spring drive mechanism and a plunger that presses against an inside surface of a caulk tube for dispensing caulk. At the end of the plunger is a piston having a flexible rim which creates a seal between the piston and an inside surface of the caulk tube, thus creating a partial vacuum in a volume between the piston and the inside end face of the caulk tube when the plunger is moved backward. The partial vacuum causes a drive plate within the caulk tube to move back into the partial vacuum, thereby relieving all built-up pressure within the caulk-filled portion of the caulk tube which immediately ends dispensing of caulk.

9 Claims, 3 Drawing Sheets

CAULK GUN

This is a division of application Ser. No. 08/269,063, filed Jun. 30, 1994.

BACKGROUND OF THE INVENTION

1. Field of the Invention

This invention relates to the field of caulk guns, and more particularly relates to dripless caulk guns.

2. Description of the Related Art

Caulk guns are used for dispensing and applying caulk. Caulk is used by building contractors and homeowners for sealing windows and doors, particularly as a means of weatherproofing and sealing out outdoor weather and air. One industry convention for dispensing caulk comprises a caulk gun in combination with a plastic or cardboard cylindrical, caulk-filled canister or tube. One end of the canister is provided with a nipple or nozzle for dispensing the caulk. Another end of the canister is provided with a drive plate (a movable end plate within the caulk tube) that rides along an interior surface of the canister and pushes against the caulk so as to dispense caulk through the nipple.

Prior art caulk guns provide a body, that receives and holds the caulk canister, a trigger and a plunger mechanism including a piston for pressing against the drive plate in the caulk canister. Many caulk guns provide a ratchet and pawl arrangement wherein the trigger may be squeezed to advance the plunger and, as the trigger is released, the pawl clicks backward along one or more notches in the plunger so that when the trigger is squeezed again it advances the plunger from its previous position. With the ratchet and pawl engaged, the plunger is not free to move backwards. To release the plunger and move it back from the canister, the plunger must be rotated to disengage the pawl from the notches in the plunger, thereby permitting the plunger to move freely backwards. One disadvantage with the ratchet and pawl system is that it drips caulk even when the trigger is released because pressure that has been built up within the canister continues to force caulk out until that pressure has been relieved and equalized with atmospheric pressure. This is a substantial drawback of the conventional caulk gun because it interferes with applying the caulk neatly and can lead to excess caulk dripping onto otherwise clean surfaces.

Another type of caulk gun, referred to herein as a biased-spring drive system, is shown in Chang, U.S. Pat. No. 4,081,112. Chang discloses a biased "plunger drive grip" that grabs a plunger rod when it is canted by a trigger. Further motion of the trigger moves the drive grip and plunger against the caulk gun for dispensing caulk. Chang provides a second trigger for releasing the plunger so it can move back to take pressure off the caulk tube. Thus, the caulk gun of Chang would drip excess caulk until the second trigger is depressed to relieve pressure in the caulk tube.

Various references disclose prior art attempts to solve the problem of dripping caulk. Finnegan, U.S. Pat. No. 4,461,407 discloses an automatic pressure release mechanism which is mounted onto a plunger rod. The release device is essentially a resilient O0-ring. The O-ring is loose enough so that the rod can slide through it but tight enough so that as trigger pressure on the plunger rod is released, the resilient memory of the O-ring will cause the plunger rod to move backward slightly, thereby releasing the pressure of the plunger on the caulk canister. As is readily apparent, a close tolerance between the O-ring and plunger is required which increases the cost of the caulk gun and provides a ready mode of failure as the O-ring wears.

SUMMARY OF THE INVENTION

The present invention solves the above-noted deficiencies by providing a dripless caulk gun that is inexpensive to make and which is reliable even under heavy use.

A preferred embodiment of the present invention comprises a modified biased-spring drive mechanism caulk gun having a flexible gasket mounted onto the end of the plunger. In general, the gasket is sized slightly larger than an inside diameter of a caulk tube surface so that as the gasket enters the caulk tube it forms a seal with the inside surface. Preferrably, the caulk gun is provided with a trigger which interacts with the biased-spring drive mechanism to move the plunger forward into the caulk tube for dispensing caulk. When the plunger is pressing against the piston in the caulk tube, the gasket will have formed a seal with the inside surface of the caulk tube. Continued pressure on the trigger will maintain the pressure of the plunger on the drive plate in the caulk tube so that continued dispensing of caulk occurs. When the trigger is released, the biased-spring drive mechanism will exert a backward force on the plunger so as to try to move the plunger in the direction away from the caulk tube's drive plate. As the plunger attempts to move backward, the gasket seals against the inside of the caulk tube, thereby creating a partial vacuum within the volume between the end of the plunger and the drive plate. That partial vacuum pulls against the drive plate, causing it to move backward, thereby instantly releasing all built-up pressure within the caulk tube. Because all the pressure from the inside of the caulk tube is relieved, the caulk instantly stops dispensing.

The foregoing and other objects, features, and advantages of the invention will become more apparent from the following detailed description of a preferred embodiment which proceeds with reference to the accompanying drawings.

DETAILED DESCRIPTION OF THE PREFERRED EMBODIMENTS

Figures 1, 2:
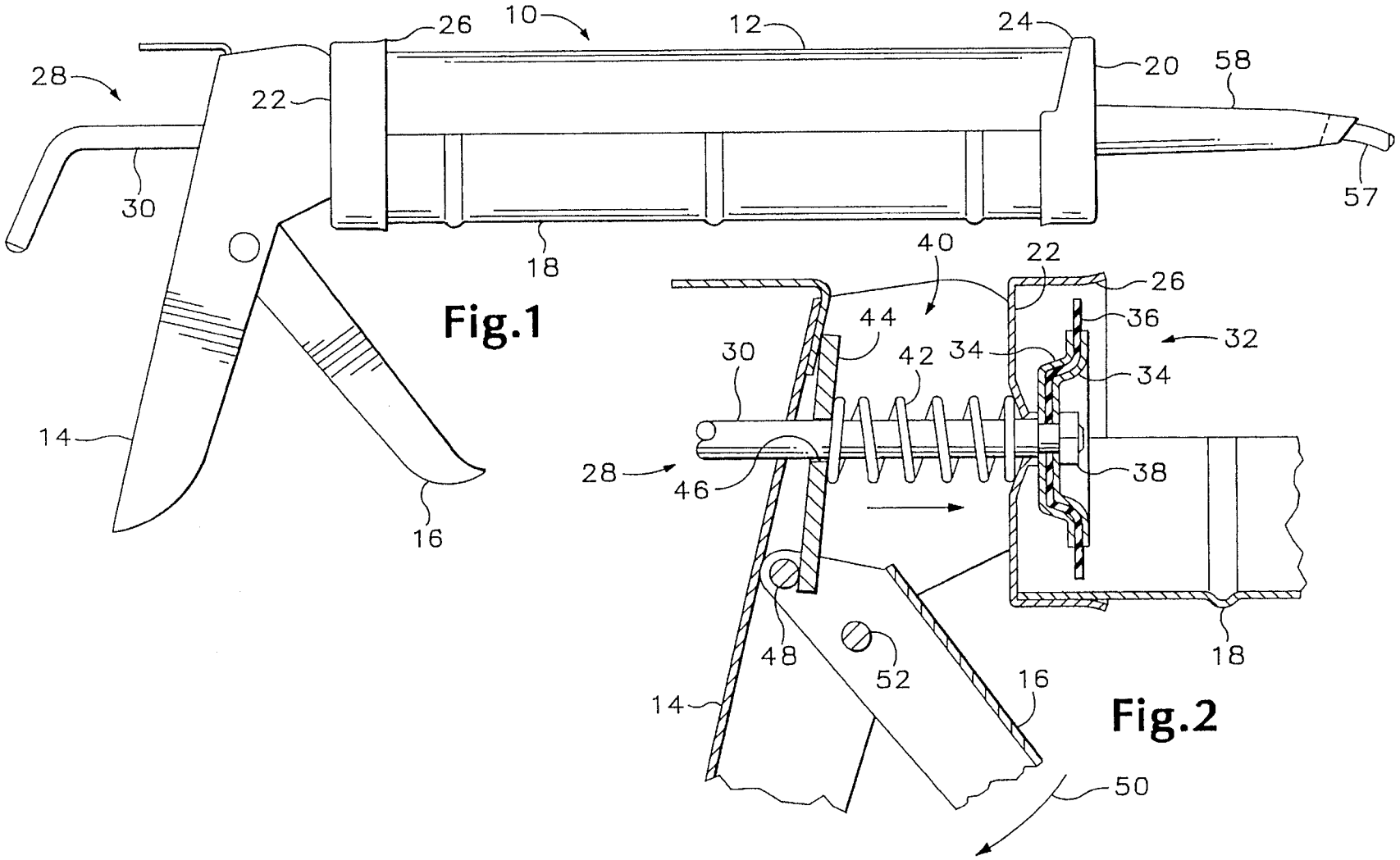
FIG. 1 is a side, elevation view showing a caulk gun of the present invention, having a canister of caulk mounted therein.
FIG. 2 is a cross-sectional view showing a drive mechanism and plunger of the present invention and showing a portion of the body, handle, and trigger of the caulk gun of FIG. 1.

With reference to FIGS. 1–4 there is shown a caulk gun 10 of the present invention. In FIG. 1, a caulk tube, or canister, 12, has been inserted in the caulk gun 10. Caulk gun 10 has a handle 14, a trigger 16, and a body 18. In the embodiment shown, the body 18 comprises a cut-away tube that has been properly sized to receive the caulk canister 12.

At either end of the body 18, there are provided end faces 20 and 22, having overhanging flanges 24 and 26, respectively, for capturing the ends of the caulk tube to hold it securely in the gun 10. There are many alternative configurations of body designs which are known to those skilled in the art.

The caulk gun 10 also includes a plunger assembly 28, having a push rod 30 and a piston 32. As seen more clearly in FIGS. 2–4, a preferred embodiment of the piston 32 has a gasket 36 which is mounted to the rod 30 between a pair of plates 34. The plates 34 and gasket 36 are disk shaped, having centrally located holes for mounting onto the rod 30. In the present embodiment, the disks 34 and gasket 36 are held onto rod 30 by nut 38. Preferably, the disks 34 are substantially rigid members such as pressed steel or other suitable metal. The gasket 36 is preferably of a flexible, resilient material such as rubber-dipped fabric or a light rubber-backed canvas. The disks 34 and gasket 36 are sized so that the gasket 36 extends radially outward past the plates 34, thereby forming a flexible, circumferential rim of the piston 32. Furthermore, the gasket 36 must be sized so that its diameter is slightly larger than an inside diameter of the caulk tube 12, as will be explained below.

Alternative embodiments of the piston include a one-piece plastic piston (FIGS. 6 and 7) having a strengthened central portion and a flexible rim. The center could be strengthened by extra material or gussets shown as pistons 32' and 32", respectively. Further alternative embodiments also include a single rigid disk adhered to a flexible gasket. Further alternatives would be obvious to those skilled in the art.

The caulk tube 10 has a drive mechanism 40 for moving the plunger which includes a biasing spring 42 and a jam plate 44 having a hole 46 for receiving the rod 30. The jam plate 46 is disposed about the rod 30 and rests against an inside surface of the handle 14 and a driving pin 48 attached to the trigger 16. The biasing spring 42 urges the jam plate away from the body 18 so that it is pressed against the driving pin 48 and the handle 14.

Figure 3:
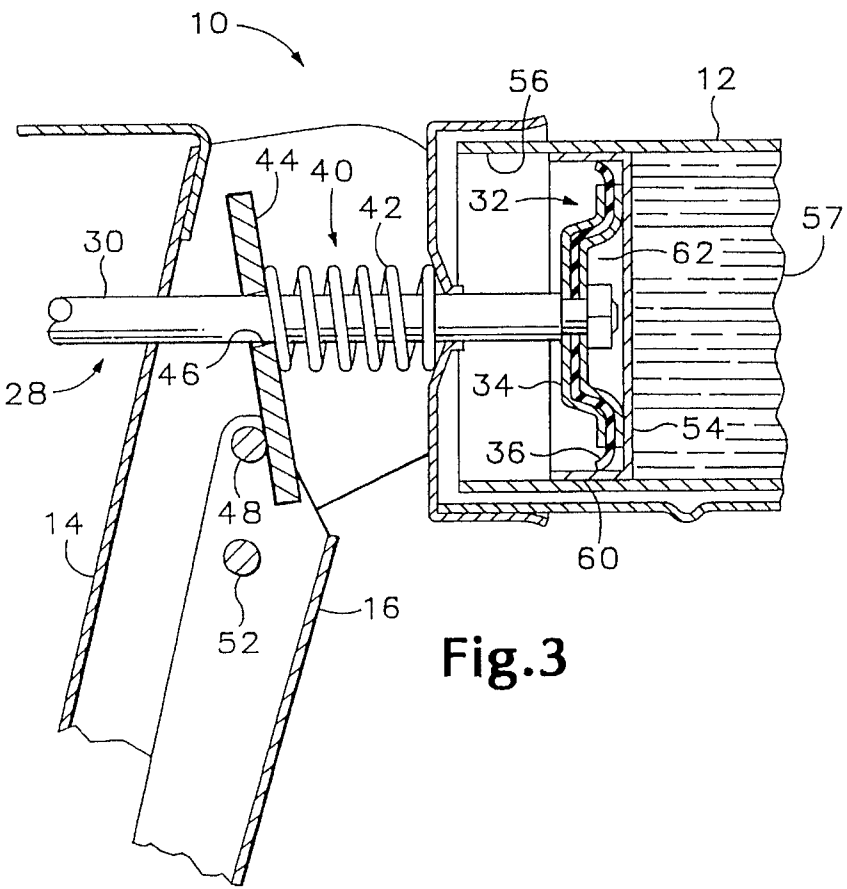
FIG. 3 is a cross-sectional view of the drive mechanism and plunger of the present invention wherein the trigger is shown in a depressed position.

The biased-spring mechanism 40 works as follows: handle 16 is operated by depressing it in the direction of arrow 50, pivoting about pivot pin 52 so that drive pin 48 moves the lower edge of the jam plate 44 forward, toward the body 18. This causes the jam plate to cant so that it jams on the rod 30 so that as the trigger 16 is moved further in the direction of arrow 50 the jam plate 44 and rod 30 move together towards the body 18. FIG. 3 shows the trigger 16 fully depressed.

Figure 4:
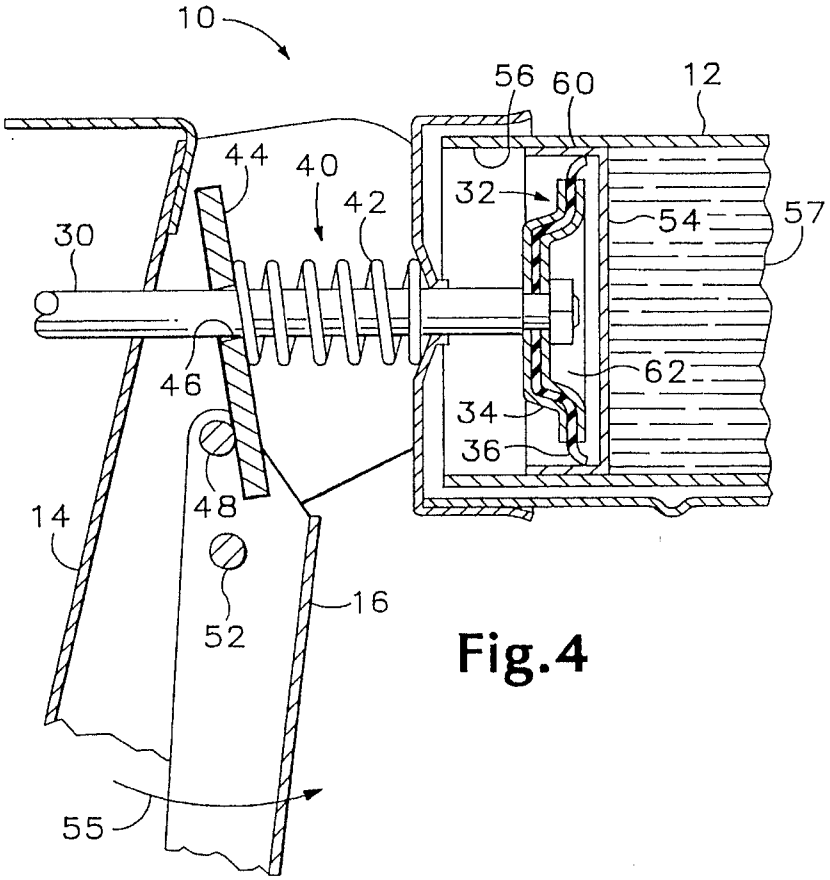
FIG. 4 is a cross-sectional view of the drive mechanism and plunger assembly of the present invention wherein the trigger is shown partially depressed.

When the trigger 16 is released so that it moves in the direction of arrow 55, as shown in FIG. 4, the jam plate 44 and rod 30 move backward, together, away from the body 18. When trigger 16 is fully released, the jam plate 44 again rests against the inside surface of the handle 14 and the drive pin 48, having been moved back into position by bias spring 42. With the trigger fully released, as shown in FIG. 2, there is no resistance on the rod and it slides freely through the handle 14, jam plate 44, bias spring 42, and body 18.

The novel features of the piston 32 permit dripless operation of the caulk gun. As noted above, the preferred embodiment of the piston comprises the rigid plates 34 which surround the flexible gasket 36 wherein the gasket has a diameter that is larger than the disk-shaped plates 34, thereby providing a flexible, circumferential rim for the piston 32. The novel and innovative operative features of the piston 32 will now be described.

As described above, operation of the trigger 16 in the direction of arrow 50 moves the plunger assembly towards the body 18. As shown in FIGS. 3 and 4, moving the plunger 28 in the direction of the body causes piston 32 or rod 30 to abut the caulk tube, thereby pushing against a drive plate 54 which is mounted inside the caulk tube 12 and which sealingly engages an interior surface 56 of the tube 12. As is well known in the art, it is pressure against the drive plate 54 which increases pressure within the caulk-filled interior of the caulk tube 12 thereby forcing caulk 57 out through a nipple 58. Thus, operation of the handle 16 pushes the plunger 28 against the drive plate 54, thereby dispensing caulk 57.

As the piston 32 or rod 30 engages the drive plate 54, the gasket 36 engages a flange 60 of drive plate 54, creating a seal with the flange 60 and trapping a portion of air in a volume 62 between the piston 32 and the drive plate 54. However, there is an insubstantial build-up of air pressure in volume 62 because the air is able to escape past the flange 36 by virtue of its configuration, much as the air is able to flow past a flapper valve in one direction.

Upon release of the trigger 16, the bias spring 42 urges the jam plate 44 back towards the handle 14. Because the jam plate 44 is still canted on rod 30, the rod is moved back with the jam plate 44 so that the piston 32 moves away from the drive plate 54 creating a partial vacuum in volume 62 by virtue of the seal between the gasket 36 and the flange 60 of the drive plate 54. Because nature abhors a vacuum, the drive plate 54 is urged backwards, in the direction of the handle 14, thereby relieving any pressure build-up within the caulk-filled portion of caulk tube 12. As soon as the pressure in the caulk-filled portion is relieved, the caulk 57 immediately ceases being dispensed through nipple 58. As the trigger is further released, caulk 57 is drawn back into nipple 58 as diagrammatically illustrated by the dotted line in FIG. 1.

Figure 6:
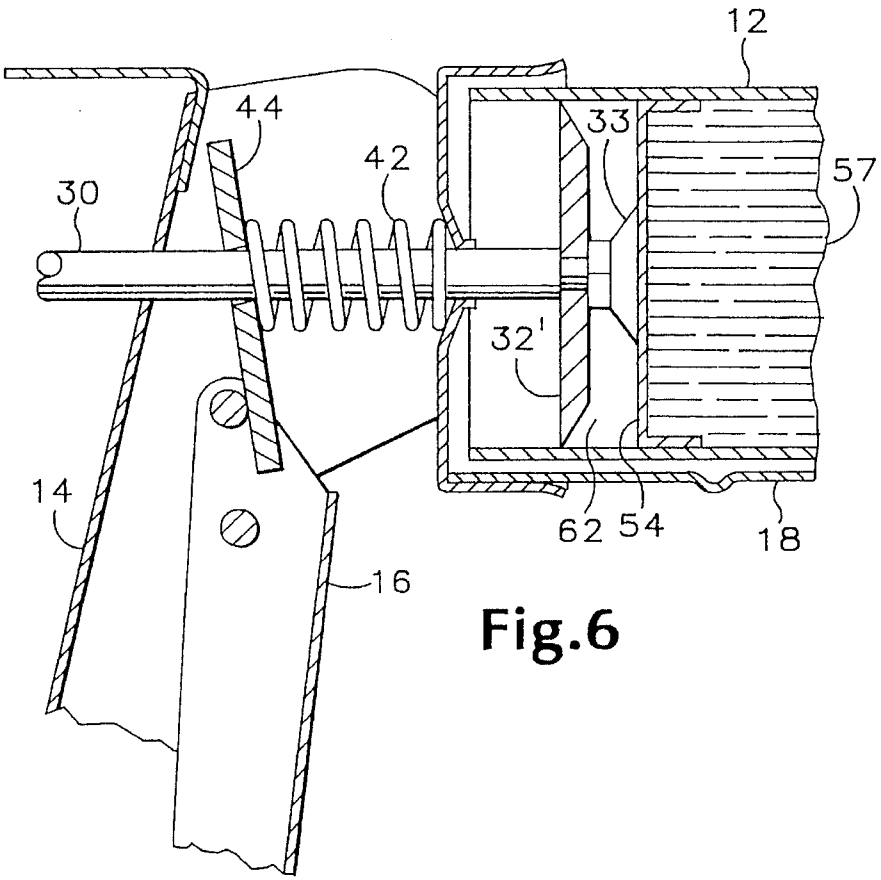
FIG. 6 is a partial cross-sectional view of an alternative embodiment of the present invention.
Figure 7:
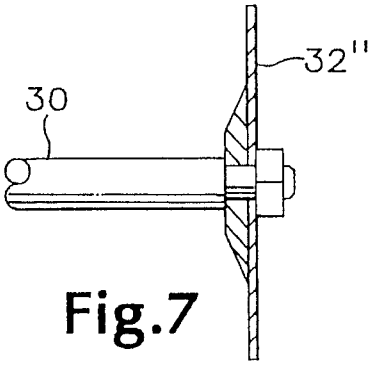
FIG. 7 is a partial cross-sectional view of an alternative embodiment of a piston of the present invention.

As noted above, there are several possible alternative embodiments of the piston 32, which might require alternative embodiments of the plunger 28 or which may operate differently. For example, using a one-piece piston 32' may require modification of the plunger assembly 28 such as adding a drive head 33 to the rod 30 for pushing against the drive plate 54. Additionally, some caulk tubes may have drive plates 54 that do not have sufficient rearwardly extending flanges 60 for sealing with the piston 32. Thus, as shown in FIG. 6, the piston may be adapted to engage interior walls 56 for creating the partial vacuum.

As noted, when the trigger 16 is in the relaxed position, as depicted in FIG. 2, the plunger 28 moves freely through the handle 14, jam plate 44, and body 18. Thus, when the piston 32 is engaged with a caulk tube 12 and the trigger 16 is relaxed and a seal is formed between the gasket 36 and the drive plate 54, the plunger 28 and caulk tube 12 move together longitudinally relative to the handle 14 and body 18. And, because most caulk guns 10 provide a sufficient amount of play between the end faces 20 and 22, it is sometimes difficult to dispense caulk because operation of the trigger 16 will simple move the plunger 28 and the caulk tube 12 together without driving the piston 32 against the drive plate 54.

Figure 5:
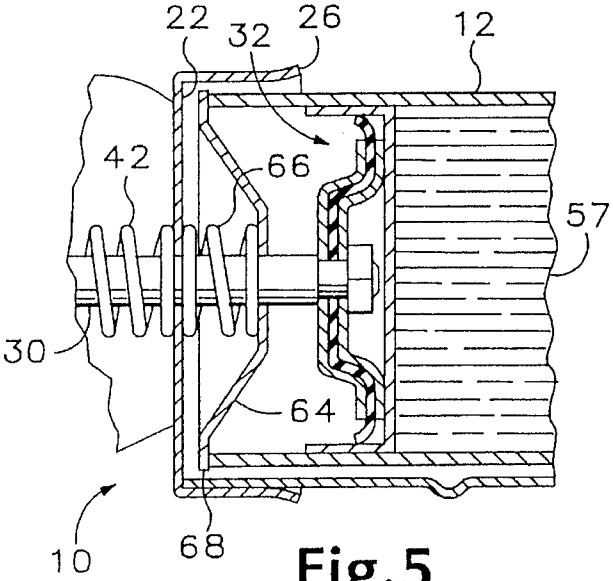
FIG. 5 is a partial cross-sectional view of a preferred embodiment of the present invention.

This problem is addressed by the embodiment shown in FIG. 5 where there is shown a back disk 64, generally shaped as a hollow frustrum-of-a-cone and having a centrally located hole for receiving rod 30. A back spring 66 is also located about rod 30, and is positioned between the end face 22 and the back disk 64. Tangs (not shown) may be provided on flange 26 for retaining the back disk 64 near the end face 22. The back disk 64 will be sized so that its outside diameter will be approximately equal to, or slightly larger than, the outside diameter of the cylindrical caulk tube 12 so that a rim 68 will contact an end 70 of the caulk tube 12 so that back spring 66 will continuously urge the caulk tube 12 towards the distal end face 20. In this manner, the caulk tube 12 is kept against the end face 20. Thus, the caulk tube may be conveniently operated when held in any orientation, even vertically.

It should be further noted that the addition of the back disk 64 and back spring 66 will create a greater partial vacuum in volume 62 as the trigger 16 is released because the caulk tube 12 will not be free to move backward. Thus, release of the trigger 16, when used in conjunction with a back disk 64 and back spring 66, will further improve the dripless operation of the caulk gun.

Having illustrated and described the principles of the invention in a preferred embodiment, it should be apparent to those skilled in the art that the invention can be modified in arrangement and detail without departing from the inventive principles.

Therefore, the illustrated embodiment should be considered only an example of the invention and not a limitation on its scope, which is defined in the following claims. We therefore claim as part of the invention all modifications and equivalents to the illustrated embodiment coming within the scope and spirit of these claims.

We claim:

1. A dripless caulk gun, comprising:

(a) an elongate body;

(b) a handle attached to the body;

(c) a trigger hingedly connected to the handle;

(d) an elongate plunger slidably connected to the body and operably connected to the trigger so that operation of the trigger moves the plunger longitudinally relative to the body, wherein the plunger has a piston at one end thereof, the piston having a flexible, circumferential rim;

(e) a cylindrical canister wherein the canister has an open end with an inside diameter and wherein the body is adapted to receive the canister; and (f) back disc having a diameter that is larger than the inside diameter of the canister, wherein the back disc is slidably connected to the plunger.

2. The caulk gun of claim 1 further including a back spring for urging the back disk against the canister.

3. A dripless caulk gun, comprising:

(a) an elongate body having a fixedly attached handle, a hingedly attached trigger, and an elongate plunger having a piston with a flexible circumferential rim, the plunger being slidably connected to the body and operably connected to the trigger so that operation of the trigger moves the plunger longitudinally relative to the body;

(b) a cylindrical canister adapted to be received by the body and having an open end with an inside diameter; and (c) a biased back disc having a diameter that is larger than the inside diameter of the canister.

4. The caulk gun of claim 3 further including a back spring for urging the back disc against the canister.

5. The caulk gun of claim 3 wherein the back disc is disposed about the plunger and slidable along the plunger.

6. The caulk gun of claim 3 wherein the back disc is slidable along the plunger and including a back spring for urging the back disc longitudinally with respect to the body.

7. A caulk gun, comprising:

(a) an elongate body having a fixedly attached handle and a hingedly attached trigger;

(b) an elongate plunger slidably attached to the body and operably attached to the trigger, the plunger having a piston at one end, the piston having a flexible circumferential rim that can sealingly engage an interior surface of a bore defined in a canister; and (c) a back plate slidably engaged with the body and biased in a direction away from the handle, wherein actuation of the trigger operates to move the plunger so the piston moves away from the handle, and deactivation of the trigger operates to move the plunger so the piston moves toward the handle, thereby the circumferential rim sealingly engages the interior surface of the canister and urges the canister toward the handle, which motion is resisted by the biased back plate.

8. The caulk gun of claim 7 wherein the back plate defines a centrally located aperture and the plunger passes through the aperture.

9. The caulk gun of claim 7 wherein the back plate is frustoconically shaped having a flared rim at a base end.

* * * * *